US010428657B2

(12) United States Patent
Warikoo et al.

(10) Patent No.: US 10,428,657 B2
(45) Date of Patent: Oct. 1, 2019

(54) METHOD FOR REPAIRING A BLADE

(71) Applicant: Pratt & Whitney Canada Corp., Longueuil (CA)

(72) Inventors: Raman Warikoo, Mississauga (CA); Krishna Prasad Balike, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 610 days.

(21) Appl. No.: 14/135,763

(22) Filed: Dec. 20, 2013

(65) Prior Publication Data

US 2014/0377075 A1 Dec. 25, 2014

Related U.S. Application Data

(60) Provisional application No. 61/838,022, filed on Jun. 21, 2013.

(51) Int. Cl.
*F01D 5/14* (2006.01)
*F01D 5/00* (2006.01)

(52) U.S. Cl.
CPC ..... *F01D 5/14* (2013.01); *F01D 5/005* (2013.01); *F05D 2220/36* (2013.01); *F05D 2230/10* (2013.01); *F05D 2250/193* (2013.01); *F05D 2250/71* (2013.01); *Y10T 29/49318* (2015.01)

(58) Field of Classification Search
CPC ..... F05D 2260/94; F05D 2260/941
See application file for complete search history.

(56) References Cited

U.S. PATENT DOCUMENTS

| | | | | |
|---|---|---|---|---|
| 3,561,886 | A | 2/1971 | Kreischer, Jr. et al. | |
| 3,564,689 | A | 2/1971 | Hirtenlechner | |
| 4,326,833 | A | 4/1982 | Zelahy et al. | |
| 4,611,744 | A | 9/1986 | Fraser et al. | |
| 4,795,313 | A | 1/1989 | Coulon | |
| 4,832,252 | A | 5/1989 | Fraser | |
| 5,033,938 | A | 7/1991 | Fraser et al. | |
| 5,062,205 | A | 11/1991 | Fraser | |
| 5,197,191 | A * | 3/1993 | Dunkman | B23P 6/002 29/402.19 |
| 6,238,187 | B1 * | 5/2001 | Dulaney | B23P 6/005 416/223 R |
| 6,413,650 | B1 | 7/2002 | Dupree et al. | |
| 6,508,000 | B2 | 1/2003 | Burke et al. | |
| 6,532,656 | B1 * | 3/2003 | Wilkins | B23K 31/02 29/402.13 |
| 6,568,077 | B1 | 5/2003 | Hellemann et al. | |
| 6,575,702 | B2 | 6/2003 | Jackson et al. | |
| 6,884,964 | B2 | 4/2005 | Murphy | |
| 7,293,964 | B2 * | 11/2007 | Gummer | B23P 6/002 29/889.1 |
| 7,780,419 | B1 | 8/2010 | Matheny et al. | |

(Continued)

*Primary Examiner* — Dwayne J White
*Assistant Examiner* — Jason G Davis
(74) *Attorney, Agent, or Firm* — Norton Rose Fulbright Canada LLP

(57) ABSTRACT

A method for repairing a blade in a gas turbine engine comprises the steps of: isolating the damage on the airfoil of the blade; forming a cut back in the shape of elongated "D" shaped recess with a pair of fillets, a depth and a longitudinal axis of the "D" shaped recess having a length along the leading or trailing edge of the airfoil; and the fillets having a respective radius.

22 Claims, 4 Drawing Sheets

(56) References Cited

U.S. PATENT DOCUMENTS

| | | | | |
|---|---|---|---|---|
| 7,841,834 | B1 | 11/2010 | Ryznic | |
| 7,858,897 | B2 | 12/2010 | Belanger | |
| 8,153,922 | B2 | 4/2012 | Belanger | |
| 8,299,389 | B2 | 10/2012 | Belanger | |
| 2007/0084906 | A1 | 4/2007 | Vargas et al. | |
| 2007/0269316 | A1* | 11/2007 | Williams ..... | B23P 6/002<br>416/223 R |

* cited by examiner

METHOD FOR REPAIRING A BLADE

CROSS-REFERENCE TO RELATED APPLICATION

The present application claims priority on U.S. Provisional Application Ser. No. 61/838,022, filed on Jun. 21, 2013.

TECHNICAL FIELD

The described subject matter relates generally to gas turbine engines, and more particularly to a method for repairing a damaged blade.

BACKGROUND ART

Compressor blades of gas turbine engines are subject to foreign object damage (FOD). The nature of the damage could vary depending on the type of the foreign object: nicks, tears, dings and blade bending are common types of damages seen in the field. In order to make the damaged blades flight worthy again, the damaged areas of the airfoil are repaired in a well-defined fashion as outlined in repair and overhaul manuals. A typical blade repair scheme involves a cut out in the area of interest that is in the shape of an arc or "C" shape.

The typical blade repair scheme is not always successful because peak steady stress and peak vibratory stress locations may both coincide at the cutback radius. The peak vibratory stress may correspond to a resonance condition. This coincidence of vibratory and steady stress peaks is a concern from a durability stand point.

There is a need to improve such repair methods.

SUMMARY

In accordance with the present disclosure, there is provided a method for repairing a blade in a gas turbine engine comprising: identifying a damage on an edge of an airfoil of the blade; forming a cutback around the damage in the edge, the cutback shaped to comprise at least a pair of fillets $r_1$, $r_2$ in the edge on opposite ends of the cutback, a depth d from the edge, and a length l along the edge.

Further in accordance with the present disclosure, there is provided a blade in a gas turbine engine comprising: an airfoil having a leading edge and a trailing edge; and a cutback machined in at least one edge among the leading and trailing edges at a location of damage, the cutback comprising a shape defined by at least a pair of fillets $r_1$, $r_2$ on opposite ends of the cutback, a depth d from the edge, and a length l along the edge.

Still further in accordance with the present disclosure, there is provided a gas turbine engine comprising: at least one blade having a leading edge and a trailing edge; and a cutback machined in at least one edge among the leading and trailing edges at a location of damage, the cutback comprising a shape defined by at least a pair of fillets $r_1$, $r_2$ on opposite ends of the cutback, a depth d from the edge, and a length l along the edge.

BRIEF DESCRIPTION OF THE DRAWINGS

Reference is now made to the accompanying figures in which.

DESCRIPTION OF THE PREFERRED EMBODIMENTS

Figure 1:
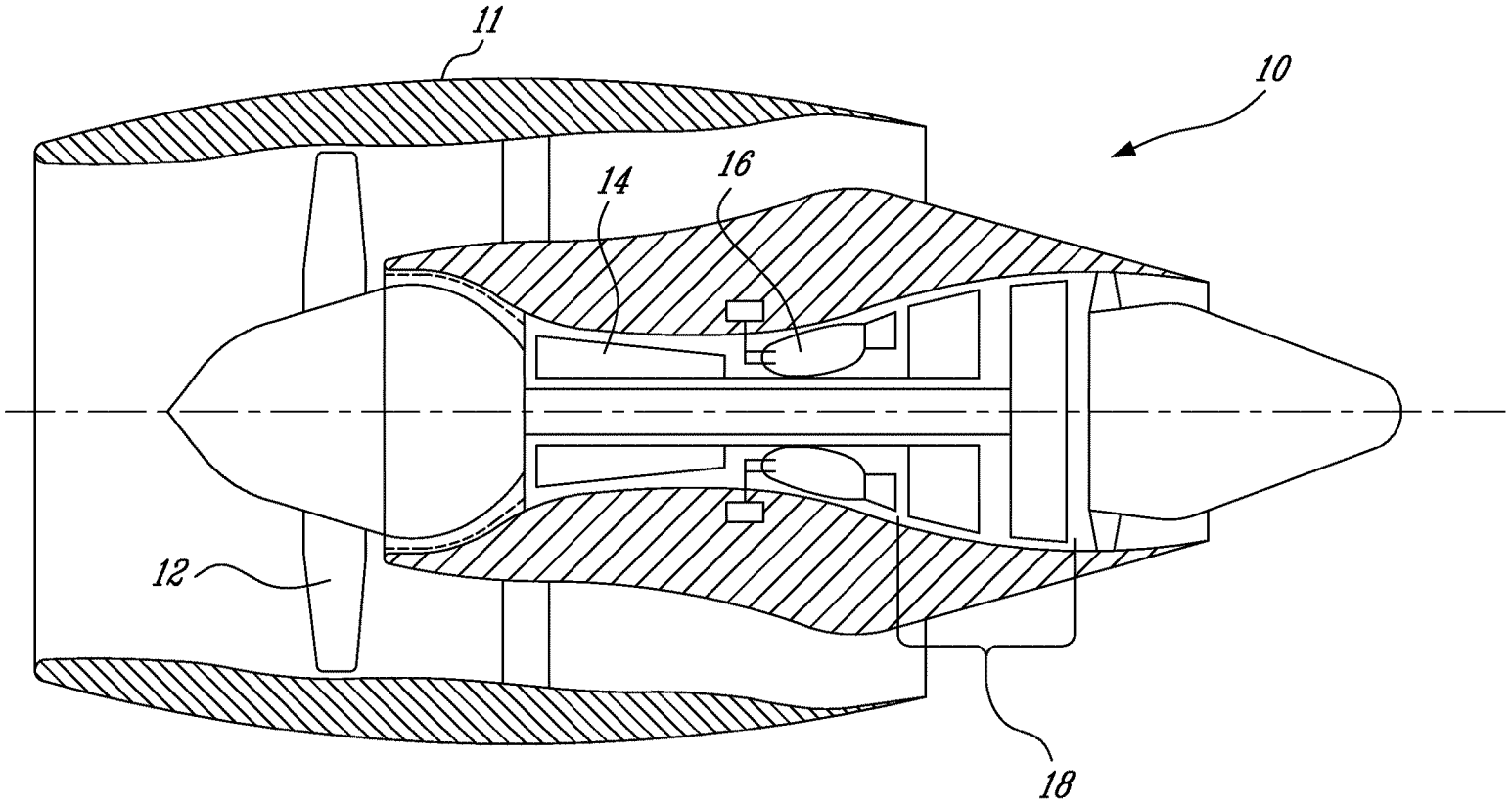
FIG. 1 is a schematic view of a longitudinal section of an embodiment of a turbofan gas turbine engine.

FIG. 1 schematically depicts a turbofan engine 10 which, as an example, illustrates the application of the described subject matter. The turbofan engine 10 includes a nacelle 11, a fan 12, a compressor module 14, a combustor module 16 and a high pressure turbine module 18.

Figure 2:
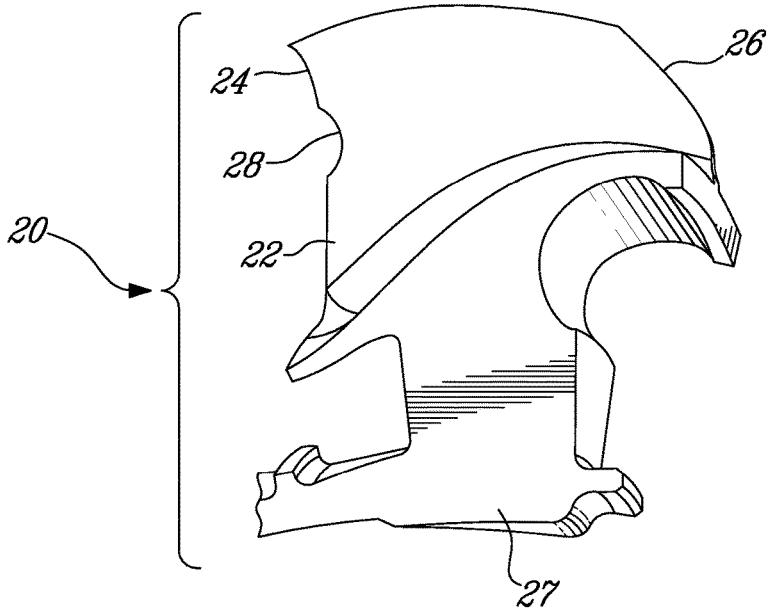
Fig. 2 PRIOR ART
FIG. 2 is a fragmentary perspective view of a blade repaired with a conventional "C" shaped cutback.
Figure 3A:
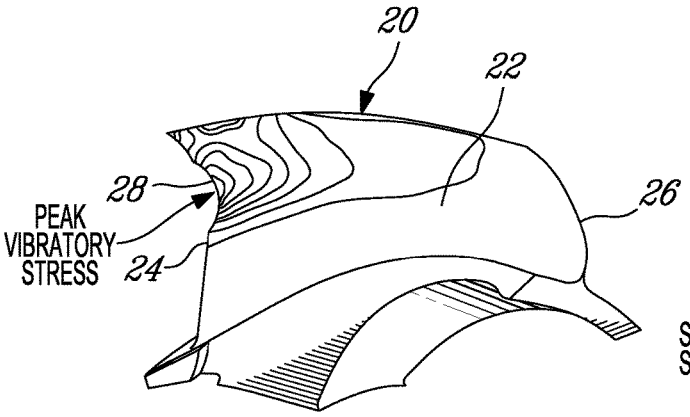
Fig. 3A PRIOR ART
FIG. 3*a* is a graphical representation of FIG. 2 showing the peak vibratory stress.
Figure 3B:
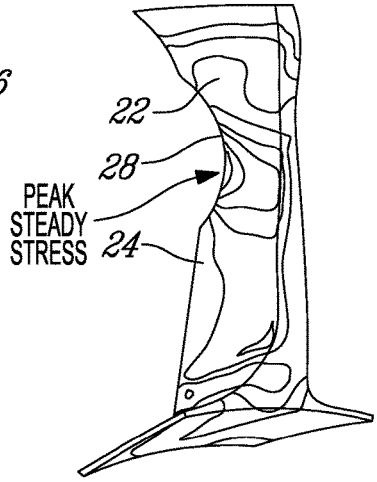
Fig. 3B PRIOR ART
FIG. 3*b* is a graphical representation showing the peak steady stress.

FIG. 2 of the prior art shows a typical compressor disc 20 with an airfoil 22, a leading edge 24 a trailing edge 26, and hub 27. As shown in FIG. 2, a repair in the form of a conventional "C" shaped cutback 28 is applied to a mid-span area of the leading edge 24. As shown in the graphs represented in FIGS. 3*a* and 3*b*, the peak vibratory stress and the steady stress peaks may coincide at the mid-span area where the repair 28 is made. This may be a cause for concern of reduced durability.

Figure 4:
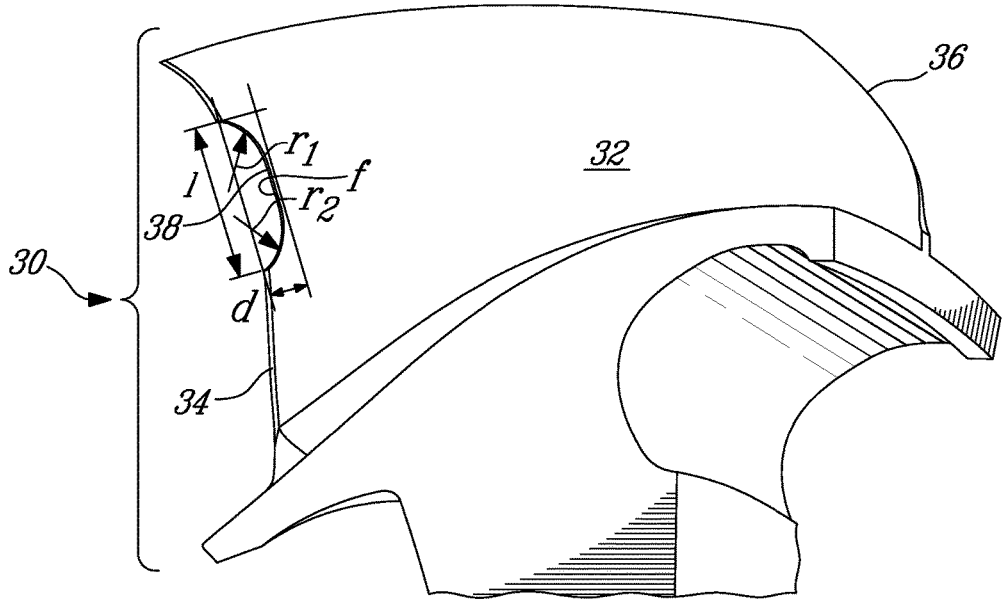
FIG. 4 is a fragmentary perspective view of a blade repaired in accordance with an embodiment of the present disclosure.

FIG. 4 shows a similar compressor disc 30 having an airfoil 32, a leading edge 34 and a trailing edge 36. A repair has the form of a "D" shaped cutback 38 (hereinafter referred to as "D" shaped for simplicity. The "D" shaped cutback 38 may be compared to an elongated recess resembling a geometric form between a rectangle and an ellipse. It is characterized by fillets $r_1$ and $r_2$. The radii of the fillets $r_1$ and $r_2$ may or may not be equal in value. It may be possible to use the same tooling if the radii of the fillets $r_1$ and $r_2$ is equal. In an embodiment, the fillets $r_1$ and $r_2$ may be spaced apart by a generally straight cutback edge f. By generally straight, it is understood that the cutback edge f may be substantially straight, or may have a radius that is substantially greater than the fillet $r_1$ and $r_2$, i.e., be quasi-straight. It is also considered not to have any edge spacing apart the fillet $r_1$ and $r_2$, whereby $1=r_1+r_2$, in a limit case for the cutback 38 which would have more of a "C" shape in this limit case.

Still referring to FIG. 4, the length l and depth d will vary depending on the damage to be repaired. Fillets $r_1$ and $r_2$ may vary as a function of the depth d. For instance, an appropriate ratio range for l/d is 1 to 20, while $r_1/d=0.2$ to 20 and $r_2/d=0.2$ to 20. The depth d is within the maximum blend limit.

For example, in proposed applications the length/may be between 1.52 mm and 76.20 mm (0.060" and 3.0'1 ford between 0.76 mm and 38.10 mm (0.030" and 1.5"), and for $r_1$, $r_2$ between 0.76 mm and 38.10 mm (0.030" and 1.5").

Figure 5A:
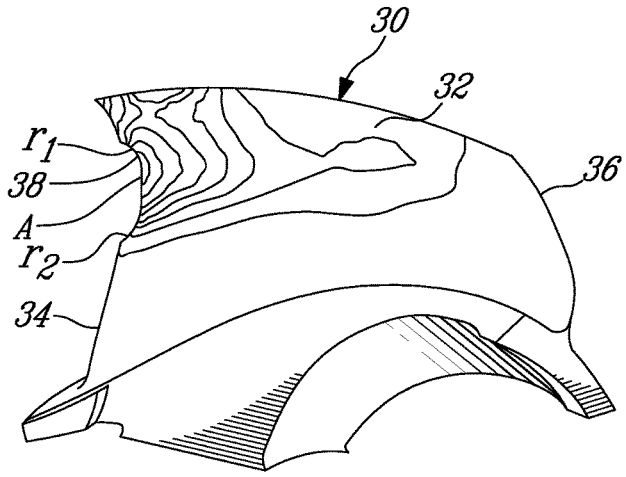
FIG. 5*a* is a graphical exemplary representation of FIG. 4 showing the peak vibratory stress on the blade of FIG. 4.
Figure 5B:
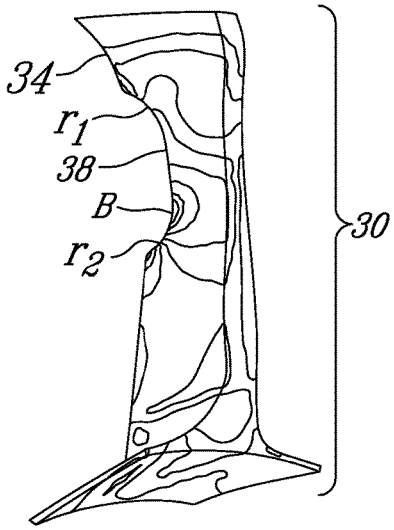
FIG. 5*b* is a graphical exemplary representation showing the peak steady stress on the blade of FIG. 4.

Referring now to FIGS. 5*a* and 5*b*, it will be seen how the peak vibratory stress is concentrated more in the area of $r_1$ (FIG. 5*a*) with a critical stress location shown as A, while the peak steady stress is located closer to the $r_2$ zone with a critical stress location shown as B. Hence, the "D" shaped cutback of repair 38 helps in decoupling peak steady stress and peak vibratory stress locations. With a "D" shaped cutback in place and appropriately located, two critical locations can be well separated, thus making the blade repair scheme acceptable.

Figure 6A:
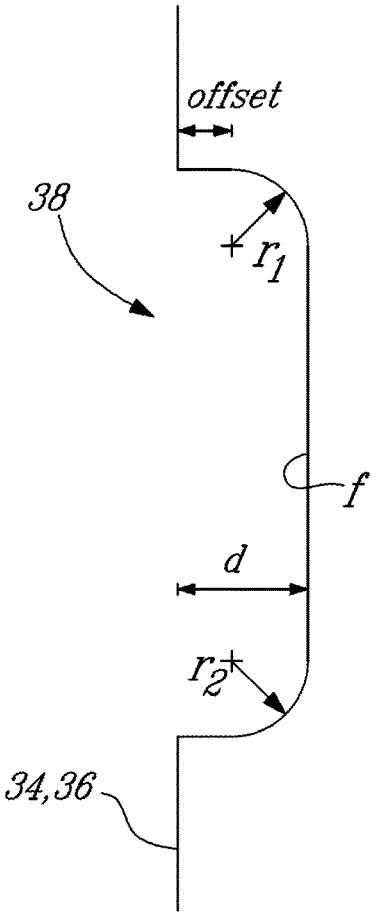
FIG. 6*a* is a schematic view of another shape of the cutback of FIG. 4.
Figure 6B:
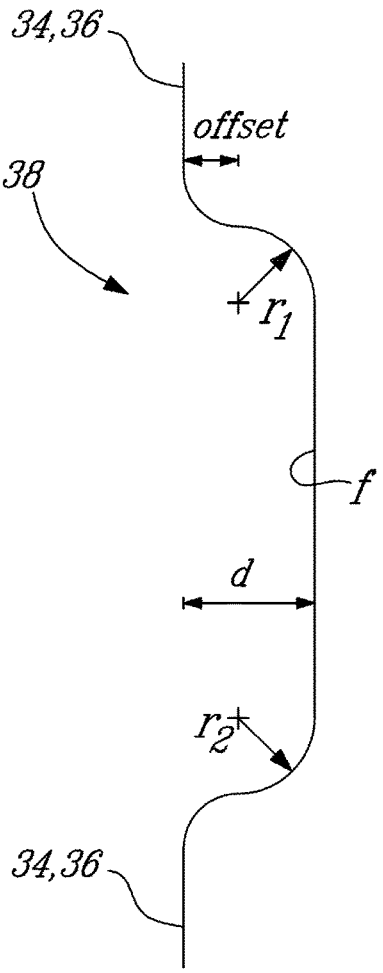
FIG. 6*b* is a schematic view of another shape of the cutback of FIG. 4.

Referring to FIGS. 6*a* and 6*b*, other alternative shapes of the cutback 38 are shown, in which the fillets $r_1$, $r_2$ are offset from the leading edge 34 (although a similar configuration could be used on the trailing edge 36 as well). The fillets $r_1$, $r_2$ are offset from the edge by straight portions as in FIG. 6*a*, or by arcuate portions, as in FIG. 6*b*, or by a combination of both, etc. The straight portions of FIG. 6*a* may be angled or perpendicular to the edge 34, 36, and may be quasi-straight, etc. In the instances of FIGS. 6*a* and 6*b*, the depth d includes the offset (if any). The offset of FIGS. 6*a* and 6*b* may be used in larger blades, for instance.

The method to repair a damage blade in accordance with the present disclosure comprises identifying a damage on a leading and/or trailing edge of an airfoil of the blade. A cutback 38 is formed about the damage in the leading and/or trailing edge, the cutback shaped to comprise at least a pair of fillets $r_1$, $r_2$ in the edge on opposite ends of the cutback, a depth d from the leading edge, and a length l in the leading or trailing edge. As the skilled reader will appreciate, a d' is selected to be suitable for the airfoil in question. For example, on larger airfoils like turbofan fan blades, a d'=10d may be appropriate, while on smaller airfoils like high pressure compressor airfoils, it may not be appropriate as d' would be too large.

The above description is meant to be exemplary only, and one skilled in the art will recognize that changes may be made to the embodiments described without departing from the scope of the invention disclosed. For example, blades in any other suitable type of engines may be repaired with the cutback 38. Still other modifications which fall within the scope of the present invention will be apparent to those skilled in the art, in light of a review of this disclosure, and such modifications are intended to fall within the appended claims.

The invention claimed is:

1. A method for repairing a blade in a gas turbine engine comprising:

identifying a damage in one of a leading edge and a trailing edge of an airfoil of the blade;

forming a cutback around the damage in the one of the leading edge and trailing edge, the cutback shaped to comprise at least a pair of fillets $r_1$ and $r_2$ in the one of the leading edge and trailing edge on opposite ends of the cutback, a depth d from the one of the leading edge and trailing edge, and a length l along the one of the leading edge and the trailing edge, a radius of each of the fillets $r_1$ and $r_2$ being shorter than the length l.

2. The method according to claim 1, wherein forming the cutback comprises forming the fillets $r_1$ and $r_2$ each with a different radius.

3. The method according to claim 1, wherein forming the cutback comprises spacing the fillets $r_1$ and $r_2$ apart relative to one another in the cutback.

4. The method according to claim 3, wherein spacing the fillets $r_1$ and $r_2$ apart relative to one another in the cutback comprises spacing the fillets $r_1$ and $r_2$ apart with one of a generally straight edge portion and an edge portion having a radius of curvature larger than $r_1$ and $r_2$.

5. The method according to claim 1, wherein forming the cutback comprises forming the cutback with l/d being from 1 to 20.

6. The method according to claim 1, wherein forming the cutback comprises forming the cutback with l being between 0.060" and 3.00"; and d being between 0.030" and 1.5".

7. The method according to claim 1, wherein forming the cutback comprises forming the cutback to have a generally constant depth from the fillet $r_1$ to the fillet $r_2$.

8. A blade in a gas turbine engine comprising:

an airfoil having a leading edge and a trailing edge; and a cutback machined one edge among the leading and trailing edges at a location of damage, the cutback comprising a shape defined by at least a pair of fillets $r_1$ and $r_2$ in the one of the leading edge and trailing edge on opposite ends of the cutback, a depth d from the one of the leading edge and trailing edge, and a length l along the one of the leading edge and trailing edge, a radius of each of the fillets $r_1$ and $r_2$ being shorter than the length l.

9. The blade according to claim 8, wherein the fillets $r_1$ and $r_2$ each have a same radius.

10. The blade according to claim 8, wherein the fillets $r_1$ and $r_2$ are spaced apart by an edge portion in the cutback.

11. The blade according to claim 10, wherein the edge portion spacing the fillets $r_1$ and $r_2$ apart relative to one another in the cutback is one of a generally straight edge portion and an edge portion having a radius of curvature larger than $r_1$ and $r_2$.

12. The blade according to claim 8, wherein the cutback is defined by l/d being from 1 to 20.

13. The blade according to claim 8, wherein the cutback is defined by l being between 0.060" and 3.00"; and d being between 0.030" and 1.5".

14. The blade according to claim 8, wherein the cutback has a generally constant depth from the fillet $r_1$ to the fillet $r_2$.

15. A gas turbine engine comprising:

at least one blade having a leading edge and a trailing edge; and a cutback machined in one of a leading edge and a trailing edge at a location of damage, the cutback comprising a shape defined by at least a pair of fillets $r_1$ and $r_2$ in the one of the leading edge and trailing edge on opposite ends of the cutback, a depth d from the one of the leading edge and trailing edge, and a length l along the one of the leading edge and trailing edge, a radius of each of the fillets $r_1$ and $r_2$ being shorter than the length l.

16. The gas turbine engine according to claim 15, wherein the fillets $r_1$ and $r_2$ each have a same radius.

17. The gas turbine engine according to claim 15, wherein the fillets $r_1$ and $r_2$ are spaced apart by an edge portion in the cutback.

18. The gas turbine engine according to claim 17, wherein the edge portion spacing the fillets $r_1$ and $r_2$ apart relative to one another in the cutback is one of a generally straight edge portion and an edge portion having a radius of curvature larger than $r_1$ and $r_2$.

19. The gas turbine engine according to claim 17, wherein the edge portion is parallel to a portion of the leading edge in which the cutback is formed.

20. The gas turbine engine according to claim 15, wherein the cutback is defined by l/d being from 1 to 20.

21. The gas turbine engine according to claim 15, wherein the cutback is defined by l being between 0.060" and 3.00"; and d being between 0.030" and 1.5".

22. The gas turbine engine according to claim 15, wherein the cutback has a generally constant depth from the fillet $r_1$ to the fillet $r_2$.

* * * * *